US007665613B2

(12) United States Patent
Scheffert

(10) Patent No.: US 7,665,613 B2
(45) Date of Patent: Feb. 23, 2010

(54) MULTI-PIECE ACCESS GATE KIT WITH CONTAINER

(76) Inventor: Mark A. Scheffert, 14956 Natchez Ave. South, Savage, MN (US) 55378

( * ) Notice: Subject to any disclaimer, the term of this patent is extended or adjusted under 35 U.S.C. 154(b) by 356 days.

(21) Appl. No.: 11/692,297

(22) Filed: Mar. 28, 2007

(65) Prior Publication Data

US 2007/0256364 A1 Nov. 8, 2007

Related U.S. Application Data

(60) Provisional application No. 60/798,692, filed on May 8, 2006.

(51) Int. Cl.
*B65D 69/00* (2006.01)
*B65D 85/00* (2006.01)
*E06B 11/02* (2006.01)

(52) U.S. Cl. ..... 206/577; 49/388; 49/394; 206/321

(58) Field of Classification Search ..... 206/321–325, 206/521, 525, 577; 49/381–403
See application file for complete search history.

(56) References Cited

U.S. PATENT DOCUMENTS 832,428 A 10/1906 Spilger
1,875,489 A * 9/1932 Peterson ..... 49/159
2,531,310 A 11/1950 Tonn
2,656,040 A 10/1953 Pope
2,701,927 A 2/1955 Dyer
2,709,862 A * 6/1955 Leslie, Jr. ..... 49/387
3,514,901 A 6/1970 Leonard
3,844,065 A 10/1974 Hrubik
3,929,225 A * 12/1975 Locke et al. ..... 206/335
3,957,251 A 5/1976 McCracken
4,353,464 A * 10/1982 Bentler ..... 206/335
4,441,579 A * 4/1984 Roberts ..... 206/335
4,537,280 A * 8/1985 Roberts ..... 206/335
4,702,036 A * 10/1987 Johnson ..... 49/394
4,807,803 A * 2/1989 Yang ..... 206/577
4,884,614 A * 12/1989 Spurling ..... 49/394
6,561,493 B1 5/2003 Lackey, Jr.

* cited by examiner

*Primary Examiner*—Bryon P Gehman
(74) *Attorney, Agent, or Firm*—Fredrikson & Byron, P.A.

(57) ABSTRACT

A multi-piece access gate kit and methods for packaging and assembling multi-piece access gates, such as driveway gates. An access gate having proximal and distal portions allowing for packaging, distribution, and retail display in a reduced footprint container. An exemplary access gate may have a distal portion that may be uncoupled from a proximal portion and placed in a substantially overlapping arrangement to facilitate placement in a reduced footprint container small enough for placement in a retail display and/or in a consumer's vehicle for transportation.

10 Claims, 11 Drawing Sheets

MULTI-PIECE ACCESS GATE KIT WITH CONTAINER

CROSS REFERENCE TO RELATED APPLICATIONS

This application claims priority to U.S. Provisional Patent Application Ser. No. 60/798,692 filed on May 8, 2006, the contents of which are incorporated by reference herein.

FIELD

The invention relates generally to access gate assemblies for restricting access, and more particularly to multi-piece access gate assemblies, which are suitable for packaging and distribution in retail environments.

BACKGROUND

Access gates, such as driveway gates, are typically used to restrict vehicular access to driveways, trails, construction sites, parking lots, lakeshore property, hunting land, and the like. Currently, access gates are produced and sold as solid, single-piece units, ranging in length from 6 to 10 feet or more. Current access gates include custom-made driveway gates, which often serve a decorative purpose. Custom-made driveway gates are often decorative, heavy, and can be very expensive, ranging from about $50-100 per foot of coverage.

A difficulty encountered by consumers is that those who wish to purchase and install their own access gates are not able to fit such a large item into a typical vehicle, such as a car. A further challenge is that retailers who might otherwise consider selling access gates are prevented from doing so due to limitations on display space, for example.

A need therefore exists for an access gate that can be packaged, distributed, and marketed in a retail environment. A need also exists for such a access gate which can be easily transported, assembled, and installed by a consumer.

SUMMARY

Certain embodiments of the invention include a multi-piece access gate for restricting access to driveways, trails, and the like, the access gate formed of two or more portions including at least a proximal portion and a distal portion coupled together to form the access gate. The proximal portion includes and upper and a lower transverse member, the lower transverse member including an upwardly extending angled portion. The distal portion includes a generally horizontal upper member and a downward extension, the downward extension including an angled portion adapted to be coupled to the upwardly extending angled portion of the proximal portion, for example, via a compression fitting.

Certain embodiments of the invention include an access gate kit, the kit including proximal and distal portions adapted to be coupled together to form a access gate, the proximal and distal portions arranged in an overlapping configuration to minimize the footprint, and a container for housing the proximal and distal portions, the container being adapted for displaying the access gate kit in a sales setting.

Certain embodiments of the invention include a method of packaging a multi-piece access gate, the method involving providing a proximal and distal portion of a multi-piece access gate, and arranging the portions in an overlapping configuration to minimize the footprint. In some embodiments, the method further comprises placing the overlapping proximal and distal portions in a container adapted for display.

Certain embodiments of the invention include a method of assembling a multi-piece access gate, the method including obtaining proximal and distal portions of a multi-piece access gate, and coupling them together to form an access gate using a compression fitting.

BRIEF DESCRIPTION OF THE DRAWINGS

Embodiments of the invention will hereinafter be described in conjunction with the following drawing figures, wherein like numerals denote like elements:

FIG. 5 (*b*) is a pictorial representation of a multi-piece access gate being transported in accordance with an embodiment of the invention;

DETAILED DESCRIPTION

Figure 1:
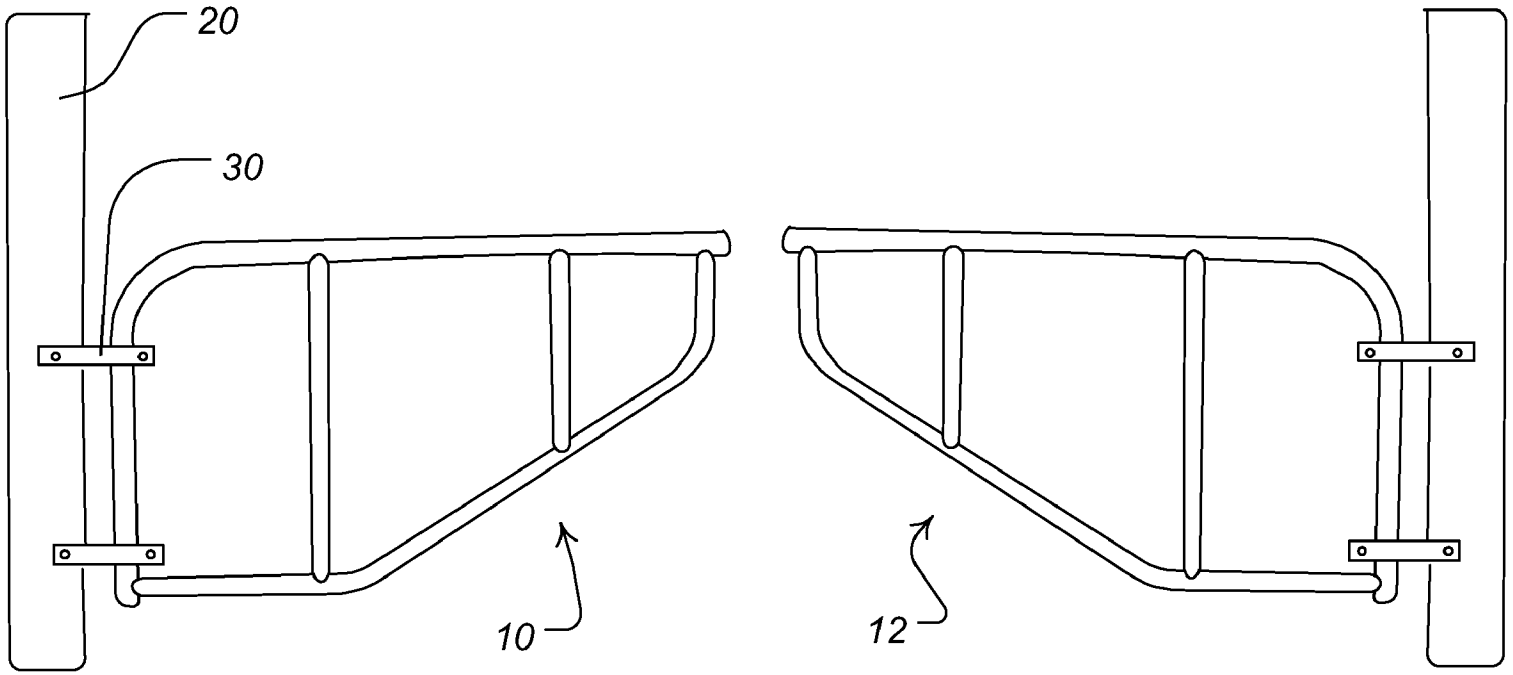
FIG. 1 is a front view of an access gate in accordance with an embodiment of the invention.

The following discussion is presented to enable a person skilled in the art to make and use the invention. Various modifications to the illustrated embodiments will be readily apparent to those skilled in the art, and the generic principles herein may be applied to other embodiments and applications without departing from the spirit and scope of the present invention as defined by the appended claims. Thus, the present invention is not intended to be limited to the embodiments shown, but is to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the invention. Skilled artisans will recognize the examples provided herein have many useful alternatives which fall within the scope of the invention as claimed.

The invention is generally a multi-piece access gate that is adapted to be packaged in a container suitable (e.g., appropriately sized) for retail display. The packaging of an access gate into a relatively small container may facilitate retail distribution by (1) allowing a typical retail consumer to purchase and transport the gate using an average-sized automobile; and (2) allowing a typical retailer to stock and display the gates in desirable retail settings.

FIG. 1 is a front view of a multi-piece access gate 10 as it may be employed according to certain embodiments of the invention. In the particular embodiment shown, access gate 10 is mounted to a support member 20 using hinges 30. Other suitable methods of supporting access gate 10 may be employed, and the invention is not limited by the means of support.

The particular embodiment illustrated in FIG. 1 also includes a second multi-piece access gate 12 used in conjunction with access gate 10 to provide the coverage needed for restricting access to a driveway, trail, park, campsite, industrial site, etc. As used herein, the term "access gate" encompasses gates which restrict access by forming a barrier that is not easily circumnavigated by a vehicle, for example. An access gate in accordance with certain embodiments of the invention may be made in a number of lengths to thereby facilitate customizing the amount of coverage provided. For example, access gates may be made available in a select number of lengths, such as 6 foot, 8 foot, and 10 foot lengths. In this limited example, the available combinations of access gate 10 optionally used in conjunction with a second access gate 12 could provide coverage across driveways having widths of 6 feet, 8 feet, 10 feet, 12 feet, 14 feet, 16 feet, 18 feet and 20 feet. For example, a multi-piece access gate 10 may be 8 feet in length (e.g., when its pieces are assembled together), and a second multi-piece access gate 12 may be 6 feet in length when assembled, presenting coverage across a 14 feet wide opening (e.g., driveway), in one particular exemplary embodiment. Many other possible length configurations would become apparent to one of ordinary skill in the art with the benefit of these teachings, and would be deemed to fall within the scope of the invention as claimed.

Figure 2:
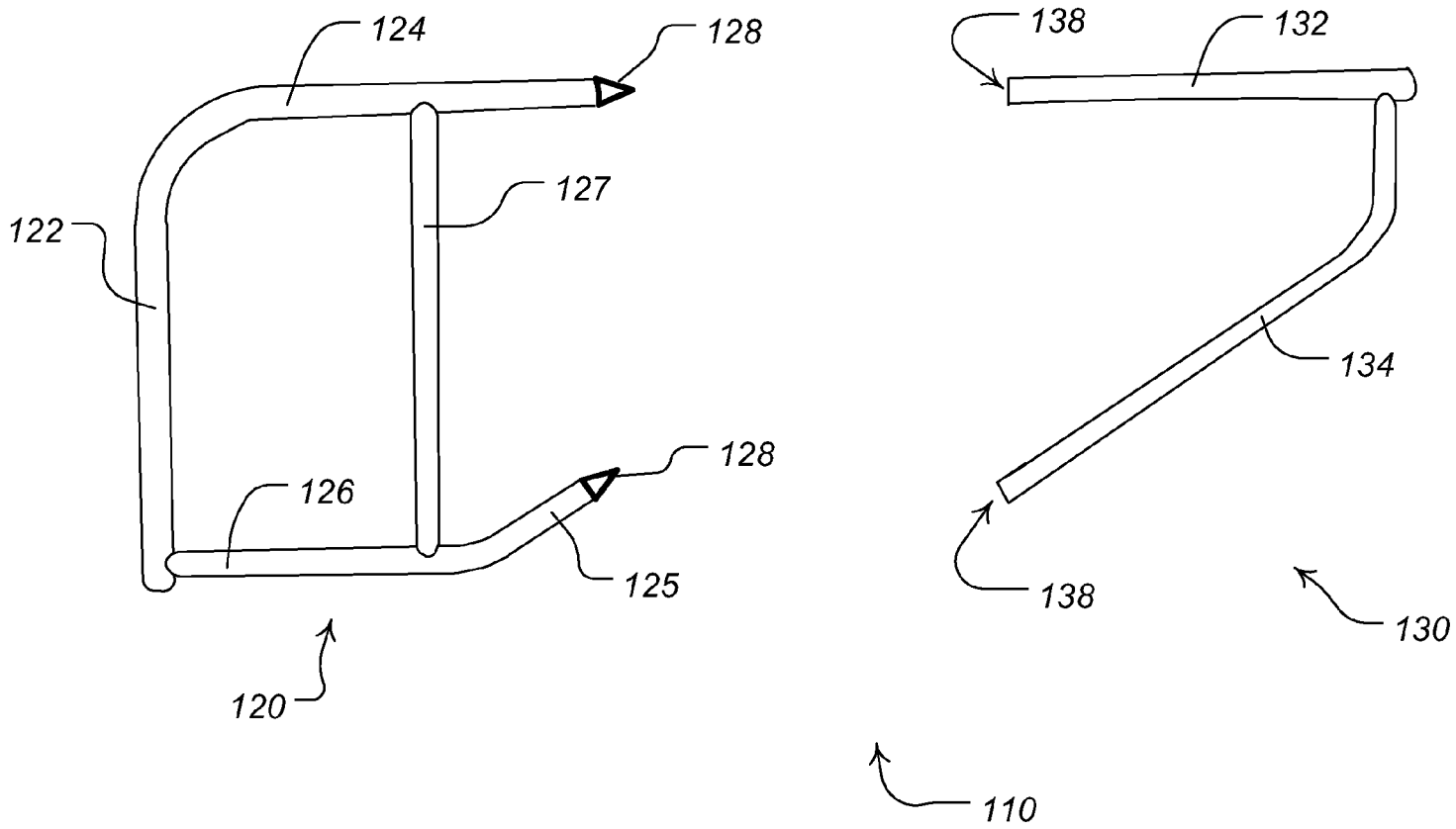
FIG. 2 is an exploded view of a multi-piece access gate in accordance with an embodiment of the invention.

FIG. 2 is an exploded view of a multi-piece access gate 110 according to certain embodiments of the invention. In the particular embodiment shown, multi-piece access gate 110 comprises a proximal portion 120 and a distal portion 130 adapted to be coupled together to form access gate 110. Proximal portion 120 comprises a base member 122 and upper and lower transverse members 124 and 126.

In certain embodiments, base member 122 of proximal portion 120 may be adapted to be hingeably coupled or mounted to a support member (e.g., the support member 20 of FIG. 1). Base member 122 may comprise a generally vertical portion of proximal portion 120, which may preferably be formed of a tubular material construction. Suitable materials for proximal portion 120 may include various metals and/or composite materials, such as fiberglass and/or various plastics, for example without limitation. A round tubular construction may be used in some embodiments to limit the weight of the access gate, while providing sufficient structural support. Other hollow tubular forms, such as square, rectangular, hexagonal, etc., may also be suitable for forming proximal portion 120, as would be recognized by one having ordinary skill in the art.

In certain embodiments of the invention, base member 122 of proximal portion 120 may extend to form at least a portion of either or both of the upper and lower transverse members 124 and 126. For example, as shown in FIG. 2, base member 122 may be extended and bent to form at least a portion of the upper transverse member 124. An embodiment could, for example, have a base member 122 that is extended and/or bent in 2 locations to form both the upper and lower transverse members 124 and 126. Alternately, either or both of the upper and lower transverse members 124 and 126 may be coupled to base member 122 using a variety of techniques known in the art, such as welding, fasteners (e.g., bolts, pins, nuts, etc.), and friction fittings, for example without limitation. For example, as shown in FIG. 2, lower transverse member 126 is coupled to base member 122 via a welded connection in some embodiments.

Figure 8B:
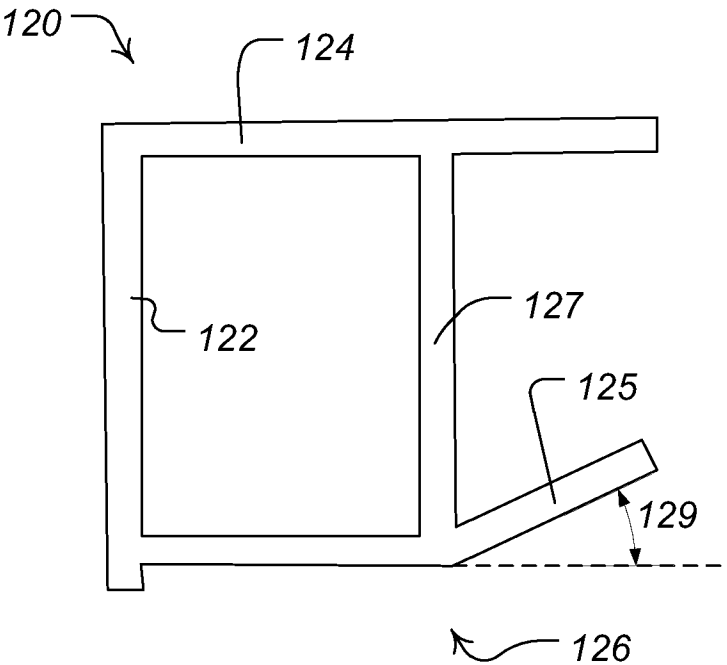
FIGS. 8(*a*) and 8(*b*) are plan views of proximal portions of a multi-piece access gate according to alternate embodiments of the invention.
Figure 8A:
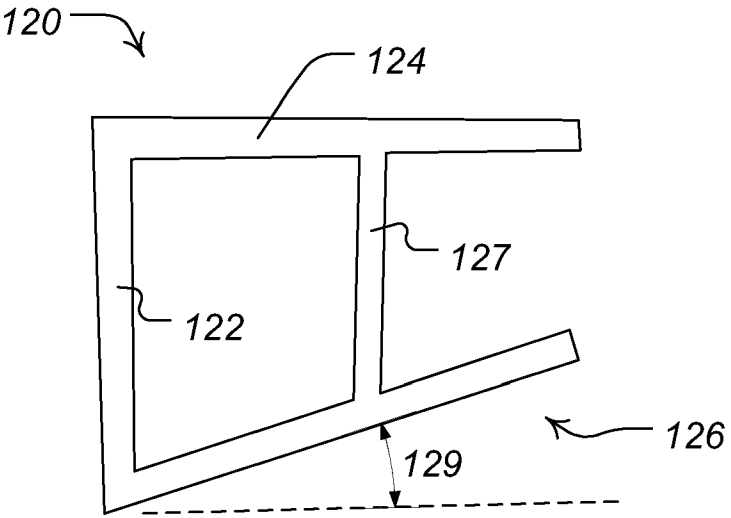

As further illustrated in FIG. 2, lower transverse member 126 may include an upward extension portion 125, forming an angle in the lower transverse member 126. It should be noted that, in some embodiments, lower transverse member 126 may comprise a single straight portion oriented upwardly at an angle 129, as shown in the embodiment illustrated in FIG. 8(*a*), rather than including both a generally horizontal portion and an angled upward extension portion 125 formed in the distal portion of lower transverse member 126, as depicted in the exemplary embodiment of FIG. 2, and as illustrated in the embodiment of FIG. 8(*b*). In other words, an embodiment of the invention such as shown in FIG. 8(*a*) may have an upward extension portion 125 that is substantially co-extensive with the entire length of lower transverse member 126, according to at least one embodiment of the invention. Referring again to FIG. 2, the distal ends of transverse members 124 and 126, may include tapered end(s) 128 to facilitate assembly by allowing for a friction fit between the proximal and distal portions 120 and 130.

In some embodiments, proximal portion 120 may also include one or more vertical support members 127, as shown in the particular example of FIG. 2. While not required in all embodiments, one or more vertical support members 127 in proximal portion 120 may provide additional structural support, and may further the ability of the access gate 110 to restrict access. Vertical support member 127 may be coupled to upper and/or lower transverse members 124 and 126 using techniques known in the art, such as welding, fasteners (e.g., bolts, pins, nuts, etc.), and friction fittings, for example without limitation.

Distal portion 130 is shown in FIG. 2, including an upper member 132 and a downward extension 134. Upper member 132 and downward extension 134 may be of a unitary construction (e.g., a single bent tubular member), or may be comprised of 2 or more members coupled or fastened together using techniques known in the art (e.g., welding, fasteners, friction fittings, etc.). In some embodiments, an optional vertical support member (not shown in FIG. 2) may also be included in distal portion 130, and may be coupled to the upper member 132 and/or the downward extension 134 using techniques known in the art. Suitable materials for distal portion 130 may include various metals and/or composite materials, such as fiberglass and/or various plastics, for example without limitation. A round tubular construction may be used in some embodiments to limit the weight of the access gate, while providing sufficient structural support. Other hollow tubular forms, such as square, rectangular, hexagonal, etc., may also be suitable for forming distal portion 130, as would be recognized by one having ordinary skill in the art.

The proximal ends of upper member 132 and downward extension 134 may be of tubular construction, and may further be adapted to receive the tapered distal ends 128 of transverse members 124 and 126 of proximal portion 120. In certain embodiments, upper member 132 and downward extension 134 may have a tapered recess portion 138 that is adapted to receive tapered distal ends 128 of members 124 and 126, and to form a friction or compression fit therewith. For example, the tapered distal ends 128 of members 124 and 126 may have a shape comprising a conical configuration that has an outer diameter that decreases linearly over the length of tapered end 128, according to certain embodiments. In preferred embodiments, the tapered shape permits a friction fit to be created between the proximal and distal portions 120, 130 by applying a force to one or both portions. As would be apparent to one of ordinary skill in the art, tapered ends may be formed on one or both of the proximal ends of distal portion 130, and tapered recess portions may be formed on one or both of the distal ends of proximal portion 120 to accomplish the same effect (e.g., to facilitate ease of assembly).

Figure 6:
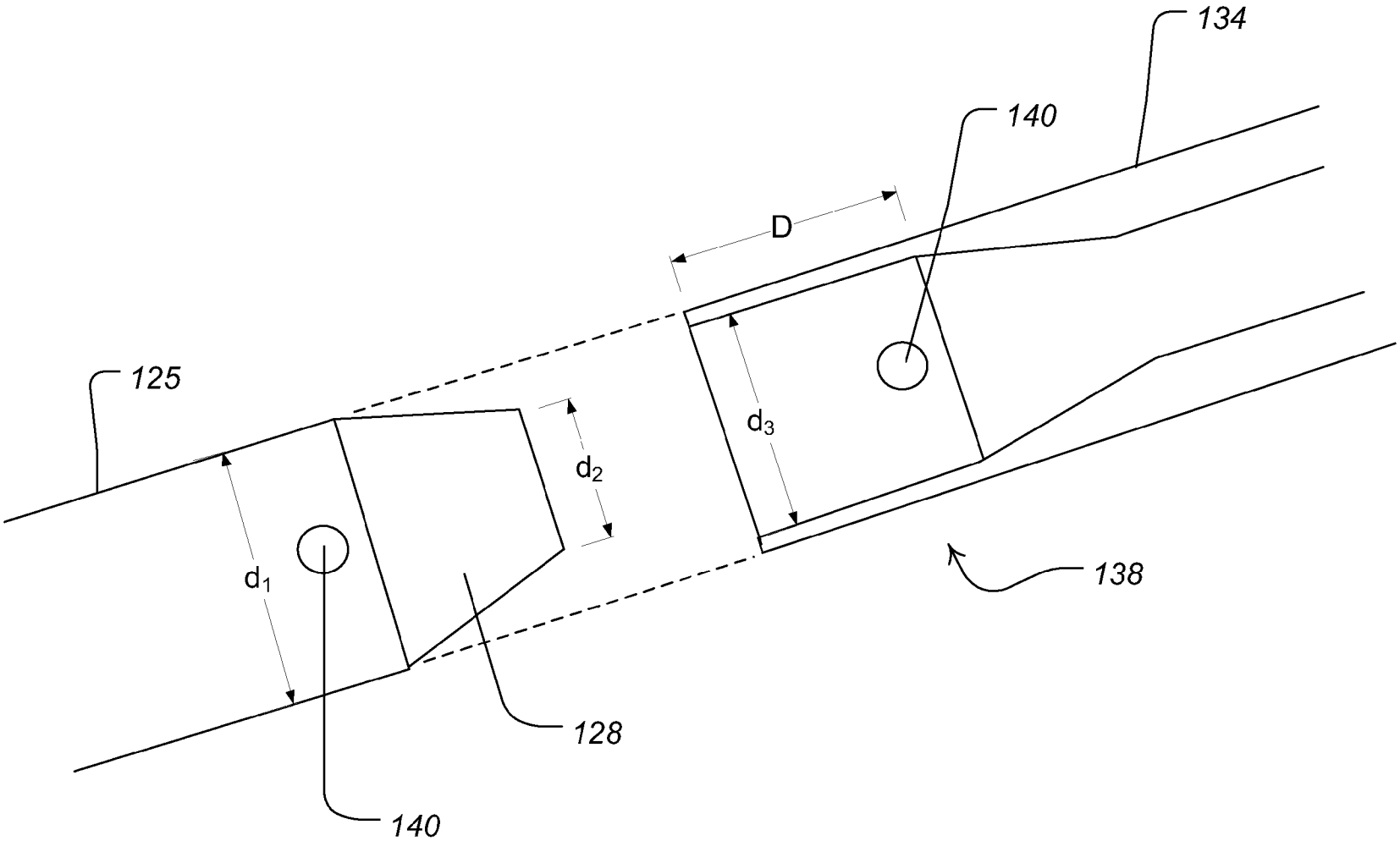
FIG. 6 is an enlarged view of a coupling for facilitating the assembly of a multi-piece access gate according to certain embodiments of the invention.

An enlarged view of a tapered distal end 128 configuration that may be used in certain embodiments of the invention is shown in FIG. 6. FIG. 6 illustrates an example of a tapered distal end 128 having a conical configuration, wherein the size (e.g., the diameter) of tapered distal end 128 decreases linearly from the outer diameter of a member (e.g., upward extension portion 125, for example), to a smaller value. For example, the size may decrease from a value of $d_1$ to a value of $d_2$ over the length of tapered end 128, generally as shown in FIG. 6. In certain embodiments, tapered recess portion 138 may have a recess with an opening that tapers from a first value to a second smaller value, as also shown in FIG. 6. In a preferred embodiment of the invention, tapered recess portion 138 has an opening where the size, $d_3$, is larger than $d_2$, but smaller than $d_1$, such that tapered recess portion 138 can be easily placed over tapered distal end 128 to achieve a friction or compression fit. In some embodiments, the tapered recess portion may be set back within the member (e.g., within downward extension 134) a certain distance D (as shown in FIG. 6), for example, to provide additional structural stability.

In some embodiments, fastening means may be provided to operate in conjunction with the tapered distal ends 128 and tapered recess portions 138. For example, a fastener such as a bolt, push pin, or other similar fastening means as are known in the art may be employed to enhance the stability of the access gate. One example of such a fastening means may include the placement of holes or apertures that extend through each of the respective tapered distal ends 128 and tapered recess portions 138, such that the holes in the tapered distal ends 128 align with the holes in the tapered recess portions 138 when the proximal and distal portions 120 and 130 are properly joined. FIG. 6 shows an example of the possible locations of holes 140 to allow for the use of various types of fastening means. A fastener such as a plastic push pin, for example, may be placed through holes 140 when the tapered distal end 128 is mated within tapered recess portion 138, according to certain embodiments of the invention. Other fasteners may be similarly employed and will be deemed to fall within the scope of the invention as claimed herein.

Figure 3:
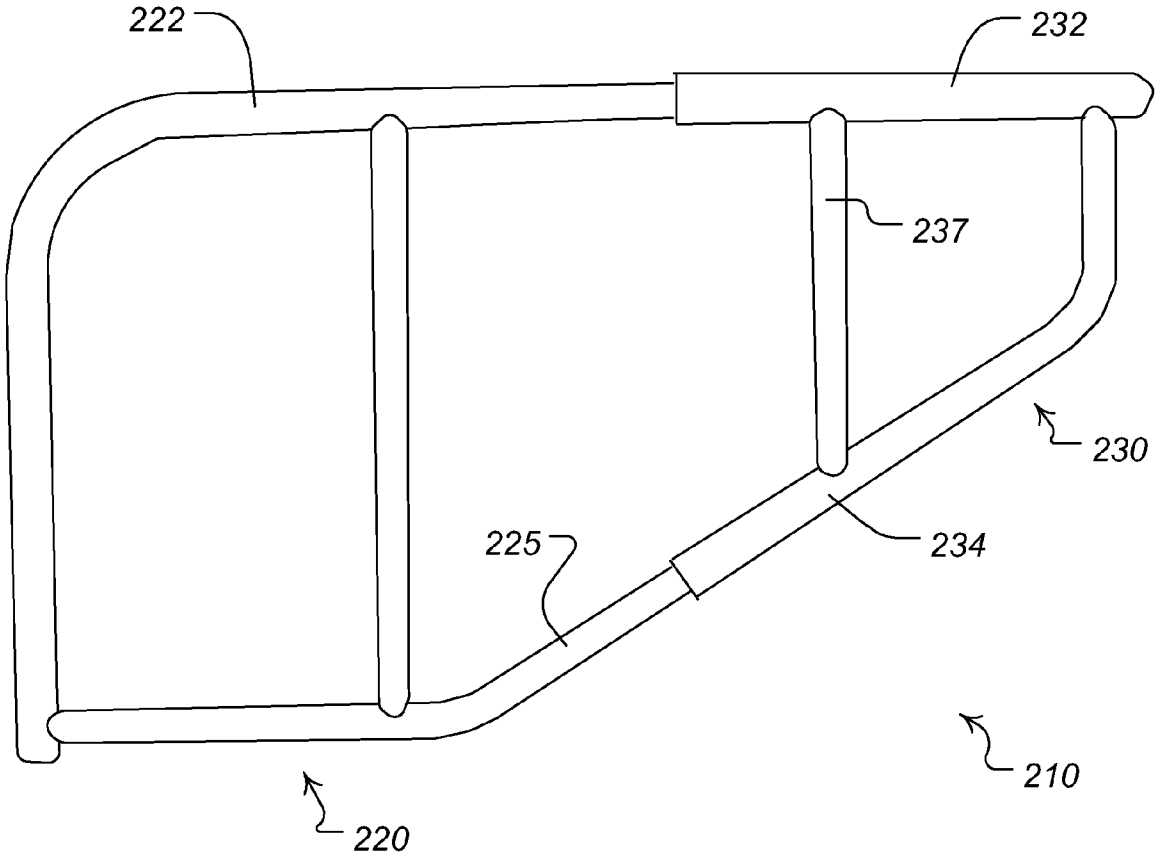
FIG. 3 is a front view of a multi-piece access gate in an assembled state in accordance with an embodiment of the invention.

FIG. 3 is a front view of an exemplary access gate 210 according to certain embodiments of the invention. FIG. 3 shows access gate 210 in an assembled configuration, wherein a proximal portion 220 and a distal portion 230 have been joined to form access gate 210. In FIG. 3 the upper transverse member 222 of the proximal portion 220 may be fitted into the upper transverse member 232 of the distal portion 230, for example, forming a friction or compression fit via a tapered end of member 222 within a tapered recess portion of member 232 in certain embodiments. The upward extension portion 225 of the proximal portion 220 may similarly be positioned into the downward extension 234 of the distal portion 230. Upon insertion, the proximal portion 220 and distal portion 230 may be held together, preferably by a frictional force. The frictional force may be augmented, for example, by tapping on one of the portions (e.g., the distal portion 230).

In FIG. 3, the assembled access gate 210 is ready to be coupled or mounted (e.g., using hinges) to a base member 20, as in the exemplary embodiment shown in FIG. 1. It should be noted that the distal portion 230 of the particular embodiment shown in FIG. 3 includes an optional vertical support member 237, in accordance with certain embodiments of the invention.

Figure 12:
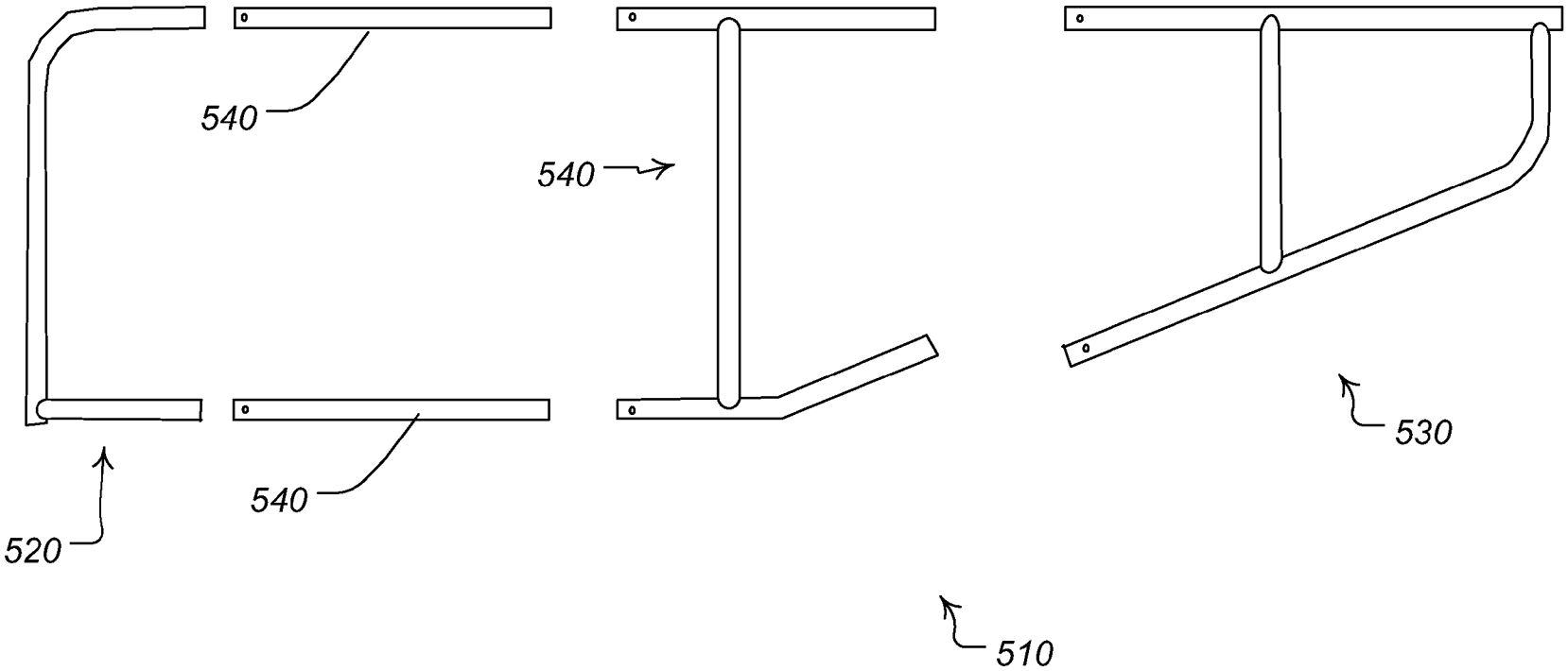
FIG. 12 is an exploded view of a multi-piece access gate in accordance with an embodiment of the invention.

FIG. 12 shows an embodiment of a multi-piece access gate 510 having a proximal portion 520, a distal portion 530, and one or more central portions 540 disposed between the proximal and distal portions. The central portions 540 may include tapered ends and/or tapered recess portions, for example, to facilitate coupling a central portion 540 to the proximal portion 520, or to the distal portion 530, or to one or more other central portions 540, according to various embodiments of the invention. In one possible embodiment, for example, a multipiece access gate 510 may include a proximal portion 520, a distal portion 530, and three central portions 540, forming a five-piece access gate as shown generally in the exemplary embodiment of FIG. 12. A preferred embodiment of the invention may include a five-piece access gate having an assembled length of about 10 feet, for example.

Figure 4:
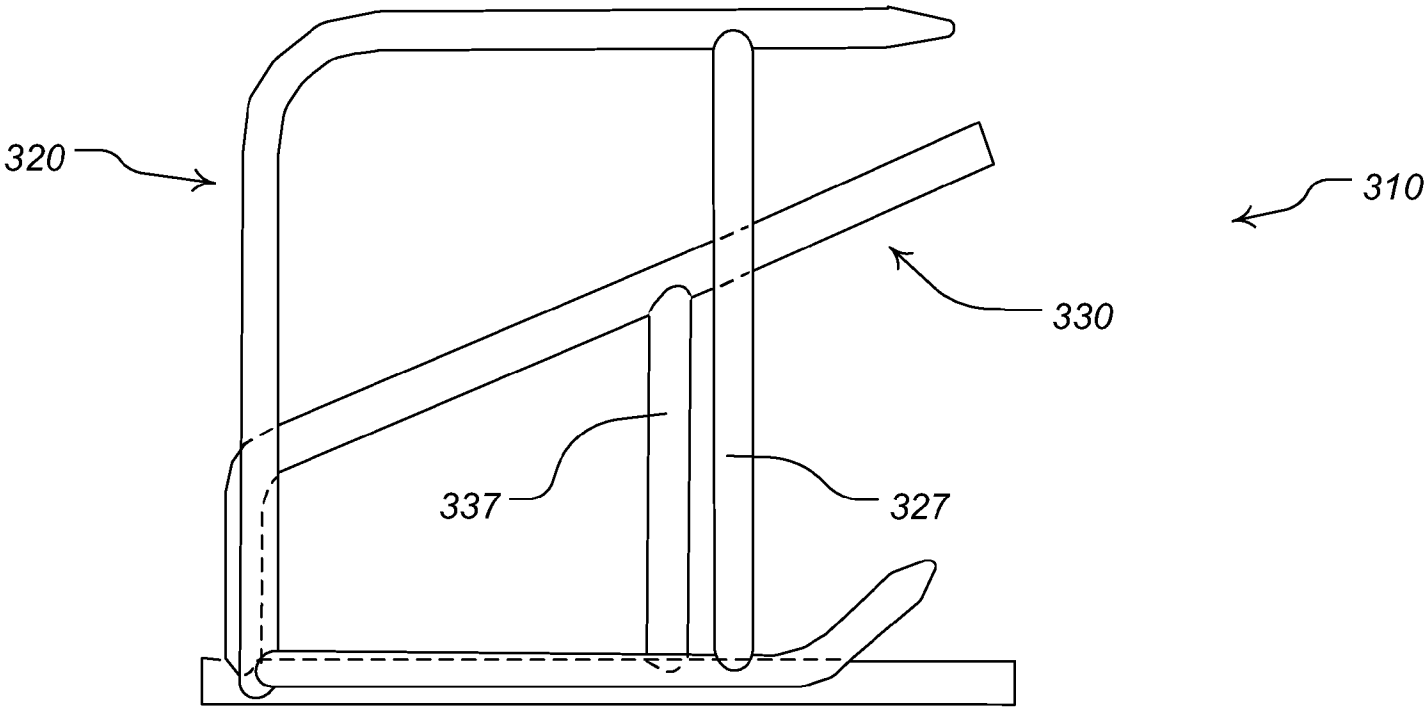
FIG. 4 is a plan view of a multi-piece access gate arranged for packaging in accordance with an embodiment of the invention.

FIG. 4 is a plan view of a multi-piece access gate 310 configured for packaging. The proximal portion 320 may be arranged on top of or beneath the distal portion 330, for example. The multi-piece access gate may be arranged in a space-efficient manner so that it takes up a relatively small amount of space when packaged, enabling the package to be fit into most types of vehicles, including automobiles, for example without limitation.

In certain embodiments of the invention, for example, one of the portions (i.e., either the proximal or distal portion 320 or 330) may be oriented to attempt to maximize the overlap of materials, and to thereby minimize the "footprint" (i.e., the surface area occupied by the two or more portions of the access gate) of the desired packaging container. In the embodiment shown, for example, the distal portion 330 has been "rotated" approximately 180 degrees relative to its normal assembled orientation (e.g., with respect to proximal portion 320). Of course, other suitable rotations, translations, and other possible orientations of the two or more portions may be employed to achieve the desired footprint. In a particularly preferred embodiment of the invention, the resulting footprint may allow the access gate to be packaged in a container that is less than about 4 feet long by about 4 feet in height, and less than about 8 inches in width. In one particular embodiment, for example, the container includes a box measuring 37 inches by 42 inches by 5¾ inches. It should also be noted that the footprint may also refer to the surface area of any two of the dimensions of the packaging container. For example, a packaging container may be placed on end in a retail setting (e.g., to display promotional images and/or product information on the relatively large surface area of the container), thereby occupying a retail footprint (e.g., floor space) of less than about 4 feet by 8 inches, according to certain embodiments of the invention.

In the embodiment shown in FIG. 4, a further advantage may be obtained by aligning the vertical support members 327 and 337 of the two portions 320 and 330, respectively. In one possible embodiment, for example, portions 320 and 330 may be aligned (e.g., placed in a parallel configuration), and resiliently coupled to each other along a portion of vertical support members 327 and 337 to minimize shifting of contents of the packaging, which may reduce scratches to the access gate during shipping, and which may give the packaged access gate a quality feel when handled by a consumer or prospective purchaser.

Figure 9B:
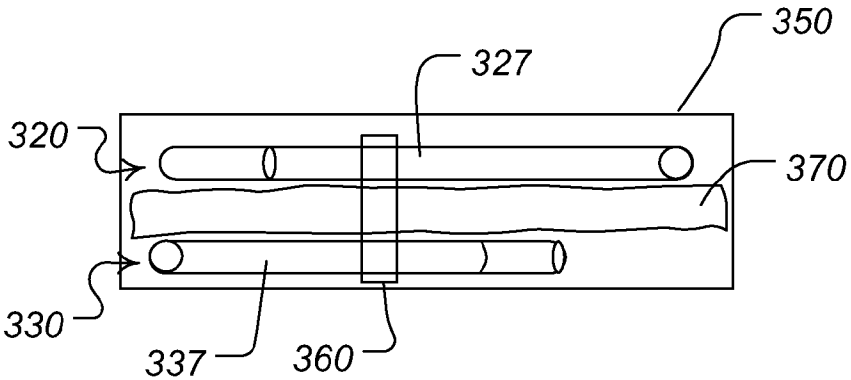
FIGS. 9(*a*) and 9(*b*) are cross-sectional views of an access gate kit in accordance with certain embodiments of the invention.
Figure 9A:
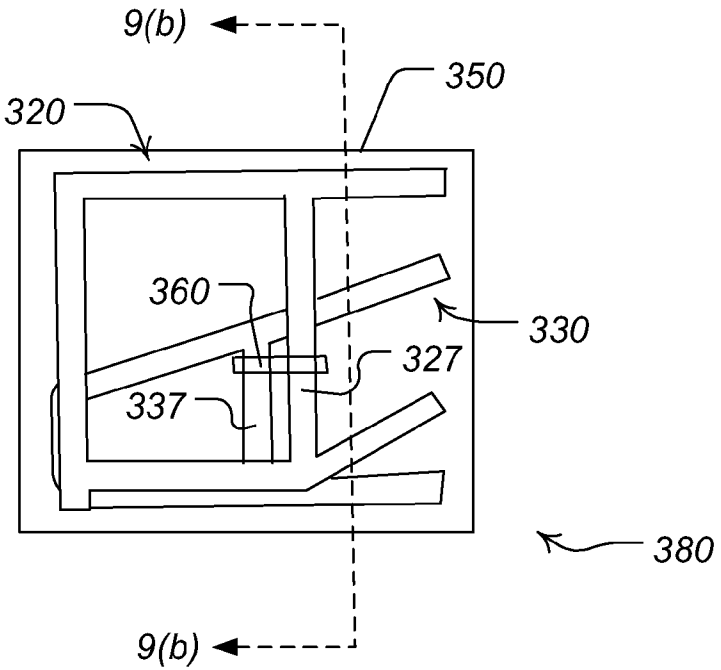

FIG. 9(*a*) is a plan view showing a multi-piece access gate kit 380 according to an embodiment of the invention. The access gate kit 380 of FIG. 9(*a*) includes a multi-piece access gate configured for packaging substantially as shown and described above with respect to FIG. 4. An access gate kit 380 according to the embodiment of the invention shown in FIG. 9(*a*) includes a container 350 for housing the proximal and distal portions of the access gate. In some embodiments, the container may comprise a generally rectangular box suitable for placement in a retail or other sales display setting. In certain preferred embodiments, kit 380 may further include one or more resilient couplings 360, which can include items such as rubber bands, elastic bands or straps, Velcro® straps (or straps with similar hook-and-loop fasteners), "zip-tie" type ratcheting fasteners, and twist-tie fasteners and the like. Coupling 360 may hold proximal and distal portions 320 and 330 together by securing the vertical support members 327, 337 together in a substantially parallel configuration, according to some embodiments.

FIG. 9(*b*) is a cross-sectional view of the multi-piece access gate kit 380 described above with respect to FIG. 9(*a*). FIG. 9(*b*) shows an optional packing separator 370, which may be used in conjunction with resilient coupling 360 to provide additional support and protection for the access gate, and to prevent the proximal and distal portions from moving and banging into each other during shipment, for example. Packaging separator 370 may be made of any suitable packing materials, such as styrofoam, or inflated plastic sheets, bubble wrap, etc., according to embodiments of the invention.

Figure 5B:
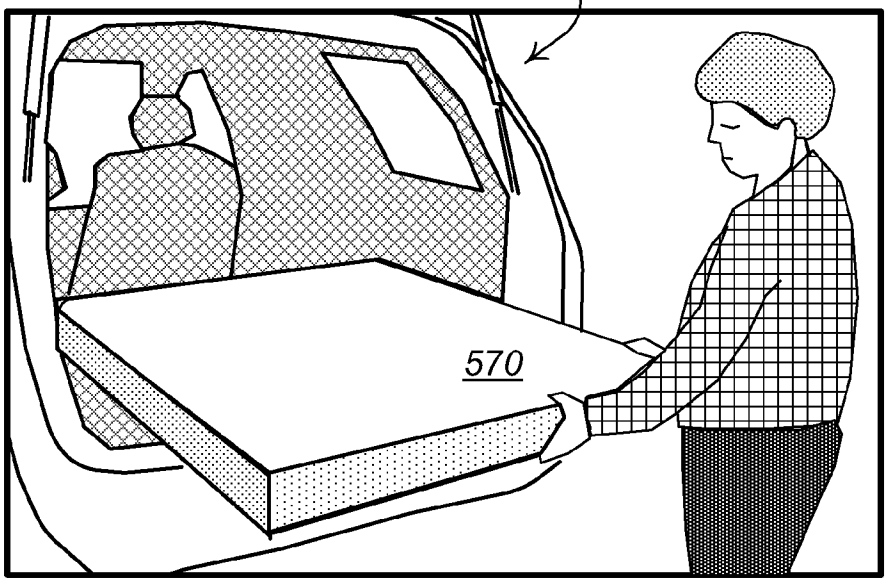
FIG. 5 (*a*) is a pictorial representation of a multi-piece access gate being assembled in accordance with an embodiment of the invention.
Figure 5A:
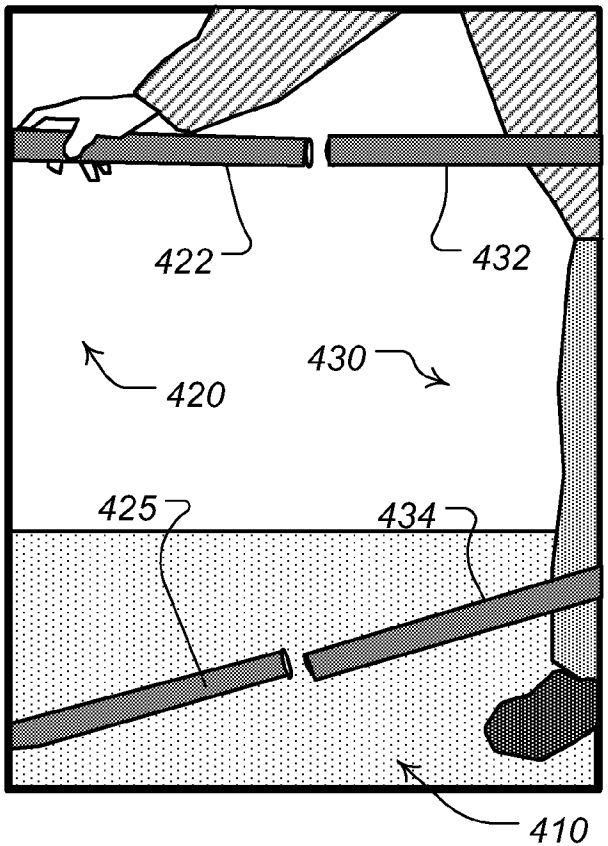

FIG. 5 (*a*) is a pictorial representation of the multi-piece access gate 410 being assembled by a retail consumer, for example. The upper transverse member 422 of the proximal portion 420 may be inserted into the upper member 432 of the distal portion 430. The upward extension portion 425 may be inserted into the downward extension 434 of the distal portion 430 substantially as shown in FIG. 5(*a*). The angle of the downward extension 434 may facilitate assembly of the access gate, since gravity will tend to assist in the aligning and joining of the lower portions.

FIG. 5 (*b*) is a pictorial representation of the multi-piece access gate being transported by a retail consumer, for example. The multi-piece access gate is packaged inside a container 570 (e.g., a cardboard box) and placed into a vehicle 575. Container 570, having a relatively small footprint, may enable a typical retail consumer to purchase the access gate at a typical retail location. The size/footprint of box 570 may further allow a typical consumer to transport the gate from a retail store display to an average-sized vehicle, and from there to a desired installation location, without requiring the use of a large truck or other special equipment. The size/footprint of box 570 may also encourage a typical retail store to stock and display the access gate, since it can be conveniently placed in desirable locations (e.g., high traffic display stands) within a store to encourage the purchase thereof by consumers. Warehousing of additional inventory may also be facilitated by the small size/footprint of box 570.

Figure 10:
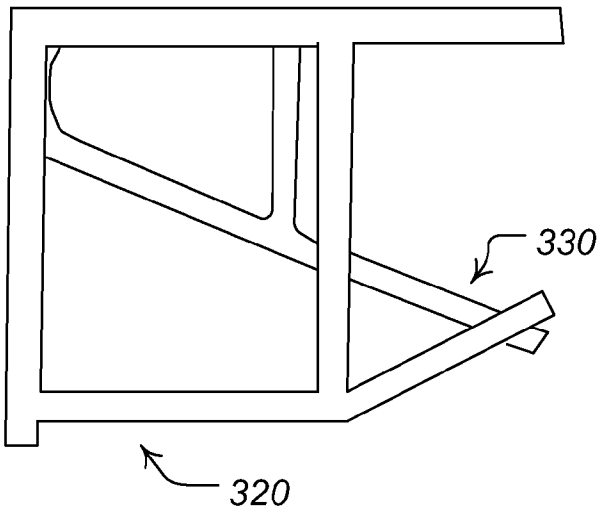
FIG. 10 is a plan view of a multi-piece access gate arranged for packaging in accordance with an embodiment of the invention.

FIG. 10 is a plan view of a multi-piece access gate 310 configured for packaging according to an embodiment of the invention. As shown, the distal portion 330 has been effectively "folded" back upon the proximal portion 320 to achieve a space-efficient packaging configuration. The proximal portion 320 may be arranged on top of or beneath the distal portion 330, for example. The multi-piece access gate 310 may be arranged in a space-efficient manner so that it takes up a relatively small amount of space when packaged, enabling the multi-piece access gate 310 (and any associated packaging materials) to be fit into most types of vehicles, including automobiles, for example without limitation. The multi-piece access gate may be placed within a packaging container, such as a box, to facilitate display in a retail setting, for example, and/or transportation of the gate by a consumer.

Figure 11:
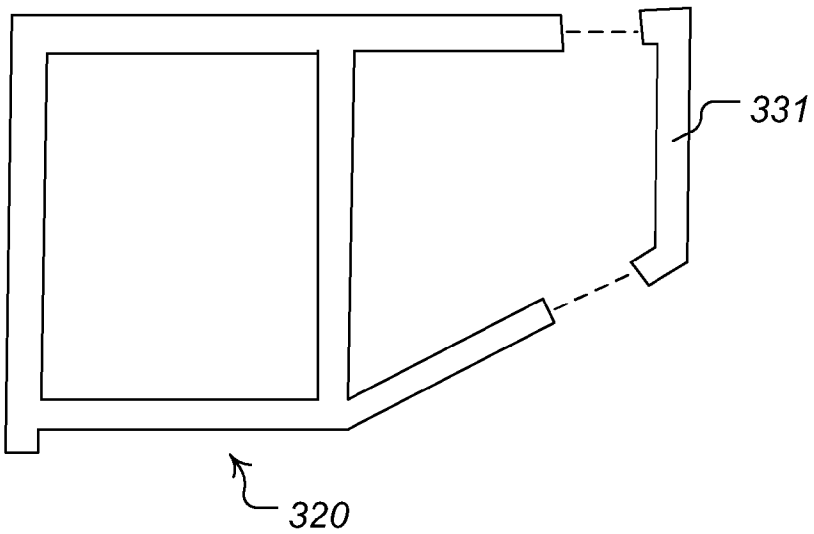
FIG. 11 is an exploded view of a multi-piece access gate in accordance with an embodiment of the invention.

FIG. 11 is an exploded front view of a multi-piece access gate 310 in which the distal portion comprises a stub portion 331. Such an embodiment may be useful in providing flexibility to a user in obtaining gate coverage over driveway openings (or other similar trail or path openings) of various widths. For example, a proximal portion and a stub portion may be used to provide coverage to restrict access on a relatively narrow path, for example, or could be used in conjunction with an embodiment in which 2 multi-piece gates are used (as in FIG. 1), one gate being a normal two-piece design, the other incorporating the stub design, to achieve coverage over an "odd" width path or driveway opening. In some embodiments, an access gate kit may include a proximal portion, a distal portion, and a stub portion, to allow user flexibility for example.

Figure 7:
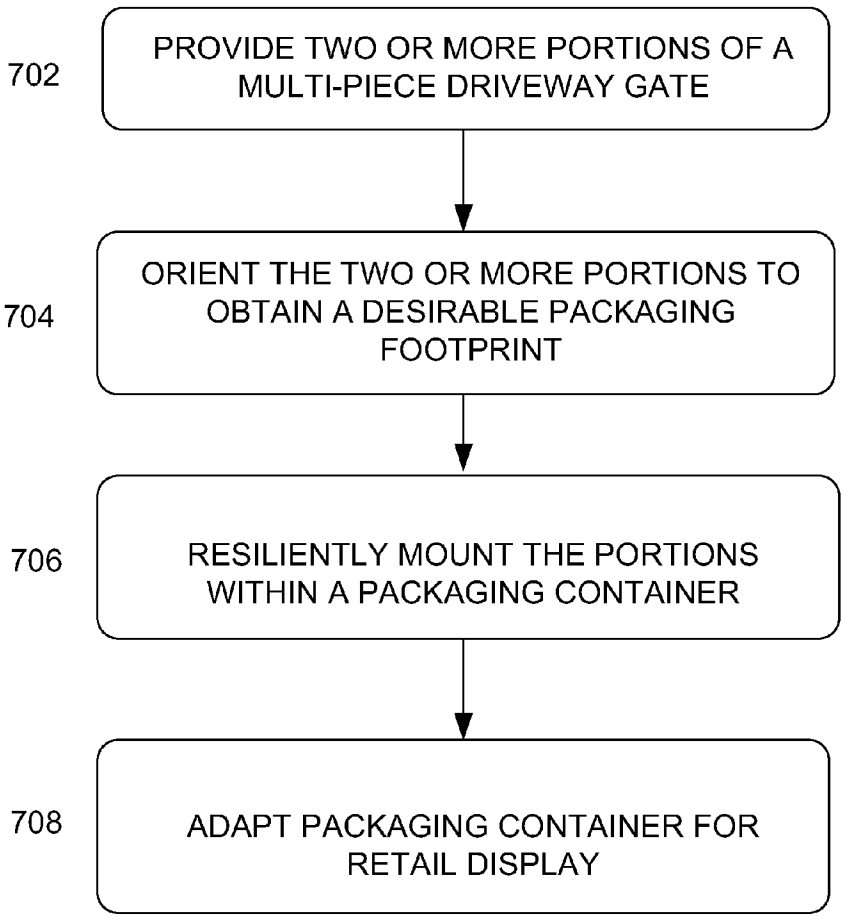
FIG. 7 is a flow chart describing a method of making a multi-piece access gate in accordance with an embodiment of the invention.

FIG. 7 is a flow chart describing a method of packaging a multi-piece access gate in accordance with an embodiment of the invention. The steps of packaging the multi-piece gate include the following: (702) provide portions of a multi-piece gate adapted to be assembled using friction or compression fittings; (704) orient the portions of the multi-piece gate relative to one another to obtain a desirable footprint for packaging; (706) place portions within packaging container, optionally using resilient coupling materials to reduce relative motion between the access gate portions; and (708) adapt packaging container for retail display (e.g., place marketing information, photographs, technical specifications, etc., on outside of packaging container).

Thus, a MULTI-PIECE ACCESS GATE has been described. While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A multi-piece access gate kit comprising:

a proximal portion of an access gate, the proximal portion including a generally vertical base member adapted to be coupled to a support, an upper transverse member extending generally horizontally from the vertical base member to a distal end thereof, over a length of the upper transverse member, and a lower transverse member extending from the vertical base member to a distal end thereof, the lower transverse member bending toward the upper transverse member to extend at an oblique angle with respect to the vertical base member in proximity to the distal end of the lower transverse member;

a distal portion of the access gate, the distal portion including a generally horizontal upper member and a downward extension, the generally horizontal upper member extending from the downward extension to a proximal end of the generally horizontal upper member over a length of the generally horizontal upper member, the proximal end of the generally horizontal upper member being configured to mate with the distal end of the upper transverse member of the proximal portion, and the downward extension extending from the generally horizontal upper member to a proximal end of the downward extension, the proximal end of the downward extension being configured to mate with the distal end of the lower transverse member of the proximal portion; and a container for housing the proximal and distal portions;

wherein, when the proximal ends of the distal portion mate with the distal ends of the proximal portion, the proximal and distal portions form the access gate; and the length of the upper transverse member of the proximal portion is approximately equal to the length of the generally horizontal upper member of the distal portion so that, when the proximal and distal portions are arranged in an overlapping configuration within the container with the proximal ends of the distal portion overlapping, and approximately aligned with, the distal ends of the proximal portion, a footprint of the proximal and distal portions of the access gate, within the container, is minimized.

2. The access gate kit of claim 1, wherein:

the distal end of each of the upper and lower transverse members of the proximal portion is tapered; and the proximal end of each of the generally horizontal upper member and downward extension of the distal portion is recessed to receive the corresponding tapered distal end of the proximal portion and thereby form a compression fit therewith, when the proximal ends of the distal portion mate with the distal ends of the proximal portion.

3. The access gate kit of claim 1, wherein:

the proximal portion of the access gate further includes a vertical support member extending from the upper transverse member to the lower transverse member, the vertical support member being spaced apart from the distal ends of the proximal portion over a first distance; and the distal portion of the access gate further includes a vertical support member extending from the generally horizontal upper member to the downward extension, the vertical support member of the distal portion being spaced apart from the proximal ends of the distal portion over a second distance, the second distance being approximately equal to the first distance; and further comprising a resilient coupling to secure together the vertical support members of the proximal and distal portions of the access gate within the container, when the proximal and distal portions are arranged in the overlapping configuration within the container.

4. The access gate kit of claim 1, further comprising a stub portion, the stub portion including a generally vertical member extending between first and second ends thereof, each of the first and second ends of the stub portion being configured to mate with the corresponding distal end of the proximal portion, in place of the proximal ends of the distal portion, to form an abbreviated access gate.

5. The access gate kit of claim 1 wherein the container has dimensions of less than about 4 feet by 4 feet by 8 inches.

6. The access gate kit of claim 1, further comprising a central portion, the central portion including a first proximal end, a second proximal end, a first distal end and a second distal end, each of the first and second proximal ends being configured to mate with a corresponding distal end of the proximal portion, and each of the first and second distal ends being configured to mate with a corresponding proximal end of the distal portion.

7. A multi-piece access gate kit comprising:

a proximal portion of an access gate, the proximal portion including a generally vertical base member adapted to be coupled to a support, an upper transverse member extending generally horizontally from the vertical base member to a distal end thereof, a lower transverse member extending from the vertical base member to a distal end thereof, and a vertical support member extending from the upper transverse member to the lower transverse member;

a distal portion of the access gate, the distal portion including a generally horizontal upper member extending to a proximal end thereof, a downward extension extending to a proximal end thereof, and a vertical support member extending from the generally horizontal upper member to the downward extension, the proximal end of the generally horizontal upper member being configured to mate with the distal end of the upper transverse member of the proximal portion, and the proximal end of the downward extension being configured to mate with the distal end of the lower transverse member of the proximal portion; and a container for housing the proximal and distal portions;

wherein, when the proximal ends of the distal portion mate with the distal ends of the proximal portion, the proximal and distal portions form the access gate; and the vertical support member of the proximal portion is spaced apart from the distal ends of the proximal portion over a first distance, and the vertical support member of the distal portion is spaced apart from the proximal ends of the distal portion over a second distance, the first distance being approximately equal to the second distance so that, when the proximal and distal portions are arranged in an overlapping configuration within the container with the vertical support members of the proximal and distal portions overlapping and approximately aligned, a footprint of the proximal and distal portions of the access gate, within the container, is minimized.

8. The access gate kit of claim 7, further comprising a resilient coupling to secure together the vertical support members of the proximal and distal portions of the access gate, when the proximal and distal portions are arranged in the overlapping configuration within the container.

9. The access gate kit of claim 7, wherein:

the distal end of each of the upper and lower transverse members of the proximal portion is tapered; and the proximal end of each of the generally horizontal upper member and downward extension of the distal portion is recessed to receive the corresponding tapered distal end of the proximal portion and thereby form a compression fit therewith, when the proximal ends of the distal portion mate with the distal ends of the proximal portion.

10. The access gate kit of claim 7, wherein the container has dimensions of less than about 4 feet by 4 feet by 8 inches.

* * * * *